US005079900A

United States Patent [19]

Pinckney et al.

[11] Patent Number: 5,079,900

[45] Date of Patent: Jan. 14, 1992

[54] METHOD AND APPARATUS FOR FORMING A TAPE HANDLE

[75] Inventors: Keith T. Pinckney, Bloomington; Thomas W. Seabold, St. Paul; Michael C. Faust, North St. Paul, all of Minn.

[73] Assignee: Minnesota Mining and Manufacturing Company, St. Paul, Minn.

[21] Appl. No.: 588,683

[22] Filed: Sep. 26, 1990

[51] Int. Cl.[5] ..... B65B 61/14

[52] U.S. Cl. ..... 53/413; 53/415; 53/134.1; 53/135.3; 53/136.4

[58] Field of Search ..... 53/134.1, 135.3, 136.4, 53/413, 415; 156/353, 361, 486, 489, 510, 516-522, 552, 566

[56] References Cited

U.S. PATENT DOCUMENTS

| | | | |
|---|---|---|---|
| 1,524,399 | 1/1925 | Krueger . | |
| 1,909,368 | 5/1933 | Lloyd . | |
| 3,031,359 | 4/1962 | Blank et al. | 154/53.5 |
| 3,409,209 | 11/1968 | Finke | 229/54 |
| 3,913,786 | 10/1975 | Kartasuk | 221/70 |
| 4,238,269 | 12/1980 | Deering, Jr. | 156/465 |
| 4,269,322 | 5/1981 | Larson | 220/94 |
| 4,296,861 | 10/1981 | Barrash | 206/428 |
| 4,679,823 | 7/1987 | Nagy | 281/15 |
| 4,716,707 | 1/1988 | Gambetti | 53/134.1 |
| 4,735,601 | 4/1988 | Cinotti | 493/88 |
| 4,745,727 | 5/1988 | Citotti | 53/134.1 |
| 4,758,301 | 7/1988 | Inoko et al. | 156/361 |
| 4,830,895 | 5/1989 | Bernard | 428/34.2 |

FOREIGN PATENT DOCUMENTS

| | | |
|---|---|---|
| 0310831 | 4/1989 | European Pat. Off. . |
| 3440958 | 5/1986 | Fed. Rep. of Germany . |
| 2596701 | 4/1987 | France . |
| WO88/08812 | 11/1988 | PCT Int'l Appl. . |
| 1124705 | 8/1968 | United Kingdom . |
| 2078500 | 1/1982 | United Kingdom . |

OTHER PUBLICATIONS

3M Matic TM 12A and 12AB Adjustable Case Sealers Brochure.

3M Matic TM 22A Adjustable Case Sealer Brochure.

3M-Matic TM 22A-Stainless Steal Adjustable Case Sealer, The Case Sealer That's Steeled for Harsh Environmental Conditions, brochure.

3M-Matic TM 77A Adjustable Case Sealer brochure.

3M-Matic TM 77R Random Case Sealer brochure.

3M-Matic TM 77R-KS Random King Size Case Sealer brochure.

*Primary Examiner*—John Sipos

*Attorney, Agent, or Firm*—Kinney & Lange

[57] ABSTRACT

An apparatus is provided for forming a tape handle for a box. The apparatus comprises a mechanism for applying to a box a strip of box sealing tape that has an adhesive side and a back side. A strip of handle tape having an adhesive side and a back side and a strip of deadening materials are supplied by the apparatus and combined so that the deadening strip is positioned on the adhesive side of the handle tape to thereby form a handle assembly having first and second adhesive sections and an intermediate masked section. The apparatus then brings the handle assembly and the box sealing tape into engagement to adhere the first and second adhesive sections of the handle assembly to the back side of the box sealing tape, and the box sealing tape is then adhered to the box.

33 Claims, 11 Drawing Sheets

Fig. 4
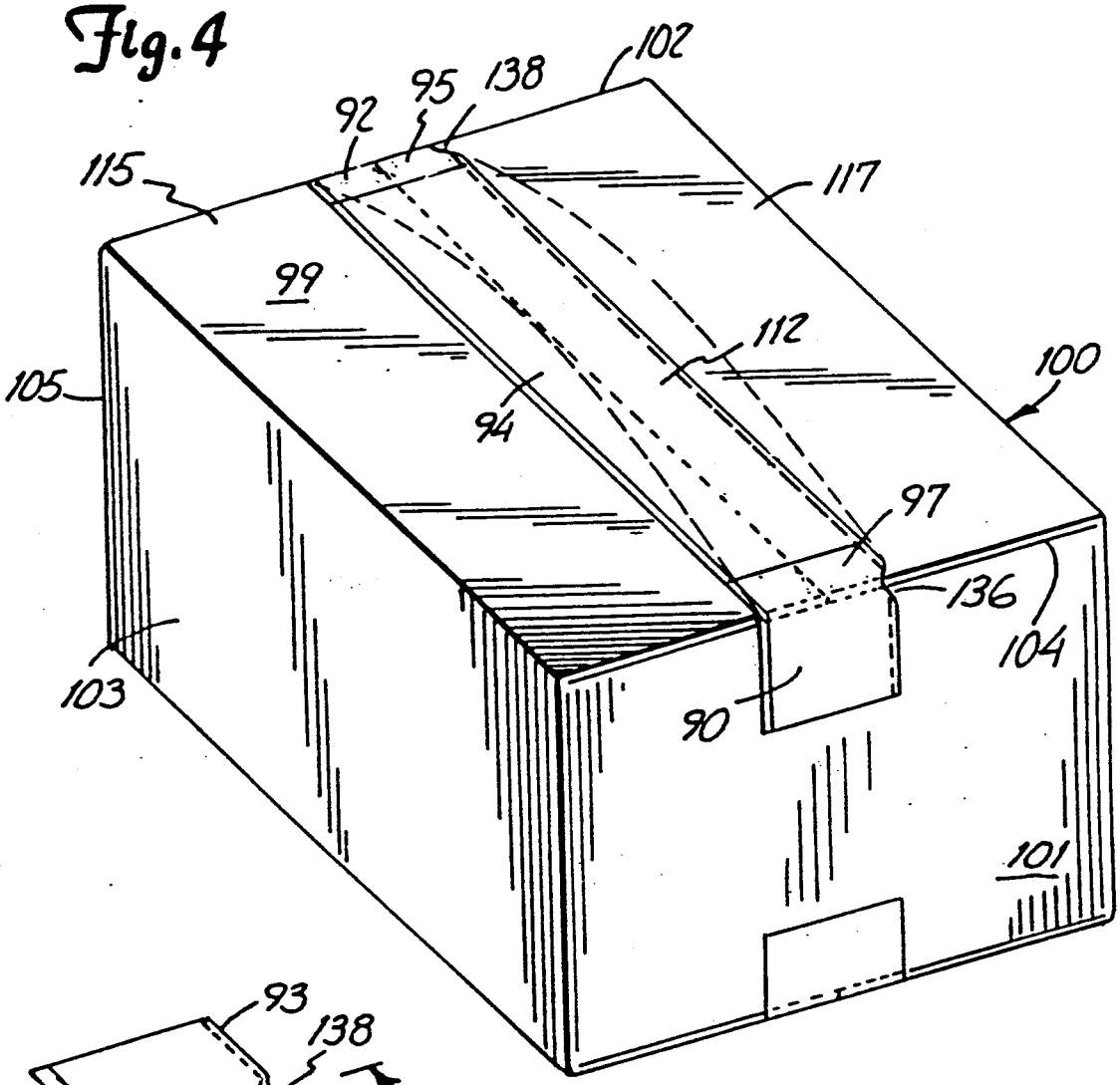
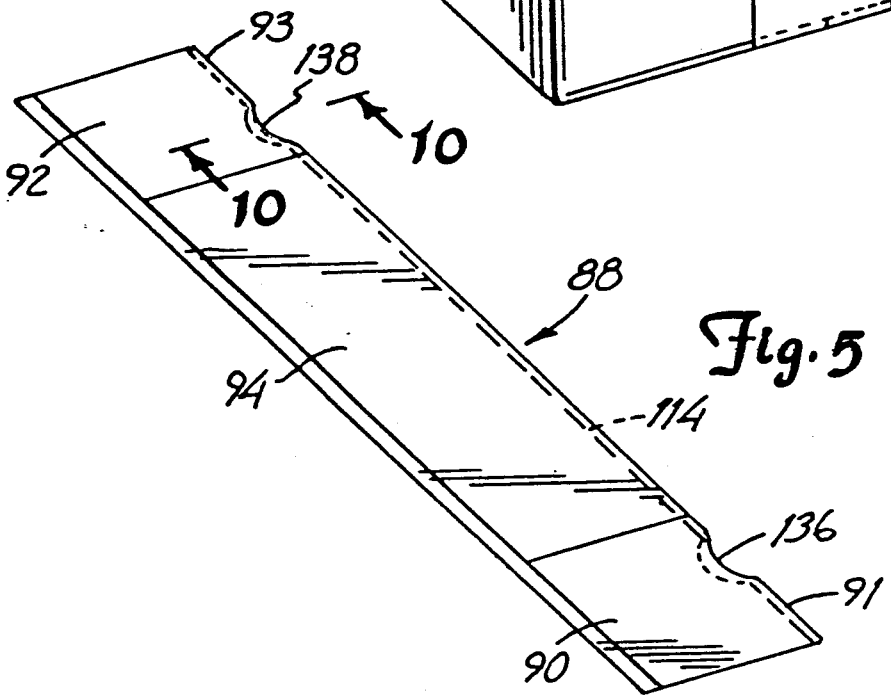
Fig. 5

METHOD AND APPARATUS FOR FORMING A TAPE HANDLE

BACKGROUND OF THE INVENTION

The present invention relates to a method and device for forming a handle constructed of adhesive-coated tape to objects such as boxes.

It is known that boxes which are continuously moving in a row on a conveyor belt can be automatically closed or sealed by means of an adhesive tape. This kind of device has been proven to be effective in that a relatively large number of cartons can be handled rather quickly. However, during subsequent loading and transportation of the boxes, the absence of a handle and the disadvantages associated with this become apparent. Often a carrying grip or handle in the form of a cord will be fastened onto a box which has already been sealed. This, however, requires additional labor and additional expense.

It is known further that a carrying handle can be designed from adhesive tapes. An example of a tape handle applied after a box has already been sealed is seen in Blank et al. U.S. Pat. No. 3,031,359. An is disclosed in Gunther PCT/US88/01505. The Blank et al. patent describes a pressure-sensitive adhesive tape handle for carrying packages consisting of a filament tape having a sheet material base of paper or other material. The tape handle is applied to the box after the box has been sealed. The Gunther PCT/US88/01505 patent describes a process for application of a carrying grip or handle by means of adhesive tape to a row of continuously moving cartons during automatic packing and sealing operations. The adhesive side of an excess length of the adhesive tape is covered or masked automatically with a cover tape in an operational step which is synchronized with the application of the adhesive tape to the carton.

Examples of devices for applying adhesive coated tape are described in Collet et al. U.S. Pat. No. 3,915,786, Patterson U.S. Pat. No. 3,954,550, and Deering, Jr. U.S. Pat. No. 4,238,269. Such devices are commonly used to seal boxes filled with merchandise. The boxes are driven past the device by a conveyor. These devices include an application member such as a roller for supporting an end of the tape with the adhesive side disposed outwardly in a contact position such that the tape end contacts the box moving towards the tape. Upon such contact, the tape end adheres to the box. As the box moves, the box pulls the tape from the device and the application member presses the tape against the contour of the box. As the box moves past the device, the applied length of tape is severed from the supply length of tape. The tape adjacent a newly severed end with the application member is moved back to its initial contact position for contact by the next box on the conveyor.

The tape handle structures disclosed in the prior art have many deficiencies. As disclosed in Blank et al., the tape handle is applied after the box sealing step has been accomplished. In addition, the ability of a tape handle to adhere to a box depends in part upon the uniformity of the surface to which the handle is applied. It is difficult to provide a uniform surface from the typical cardboard box surfaces for the tape handle application. Further, extra steps and time are required to apply the Blank et al. handle to the box. As disclosed in Gunther, the tape handle is formed from the same tape which is being used to seal the box. By using the box sealing tape as the handle, the box cannot be sealed along its entire lid thereby allowing a portion of the box to remain unsealed. In addition, there is a greater chance of the handle and the sealing tape being removed or peeled away from the box by any rocking or swinging of the box while the box is being lifted or carried. In addition, to deficiencies found in the known handle structures themselves, the known arrangements and methods for forming such handles are inefficient and ineffective. As noted above, extra steps in the box finishing process may result in time delays and thus greater costs. A simple and efficient arrangement for forming and applying a tape handle to a box is thus desired.

In addition to the above, with a box having a pour opening adjacent a top edge of a pour side, such as laundry detergent boxes and the like, any handle must be mounted along the sides of the box in order to be able to carry the box by the handle after the box has been opened. If the handle is mounted at the top of this type of box, the handle would pull the lid open and the box would tip thereby spilling the contents of the box. A simple and efficient arrangement for forming and applying a tape handle to a box having a pour opening, such as a laundry detergent box, is thus desired.

SUMMARY OF THE INVENTION

An apparatus is provided for forming a tape handle on a box. The apparatus includes a mechanism for applying a strip of box sealing tape to the box with the box sealing tape having an adhesive side and a back side. The apparatus also has a mechanism for providing a strip of handle tape having an adhesive side and a back side and a mechanism for providing a strip of deadening material, with the deadening material being shorter in length than the handle tape. A mechanism is provided for positioning the deadening strip on the adhesive side of the handle tape thereby forming a handle assembly having first and second adhesive sections and an intermediate masked section. The apparatus further includes a mechanism for adhering the first and second adhesive sections of the handle assembly to the back side of the box sealing tape.

BRIEF DESCRIPTION OF THE DRAWINGS

FIG. 4 is a perspective view of a tape handle of the present, invention attached to a box.

FIG. 5 is a perspective view of the tape handle of the present invention separate from a box and laid flat.

DETAILED DESCRIPTION OF THE PREFERRED EMBODIMENTS

Figure 1:
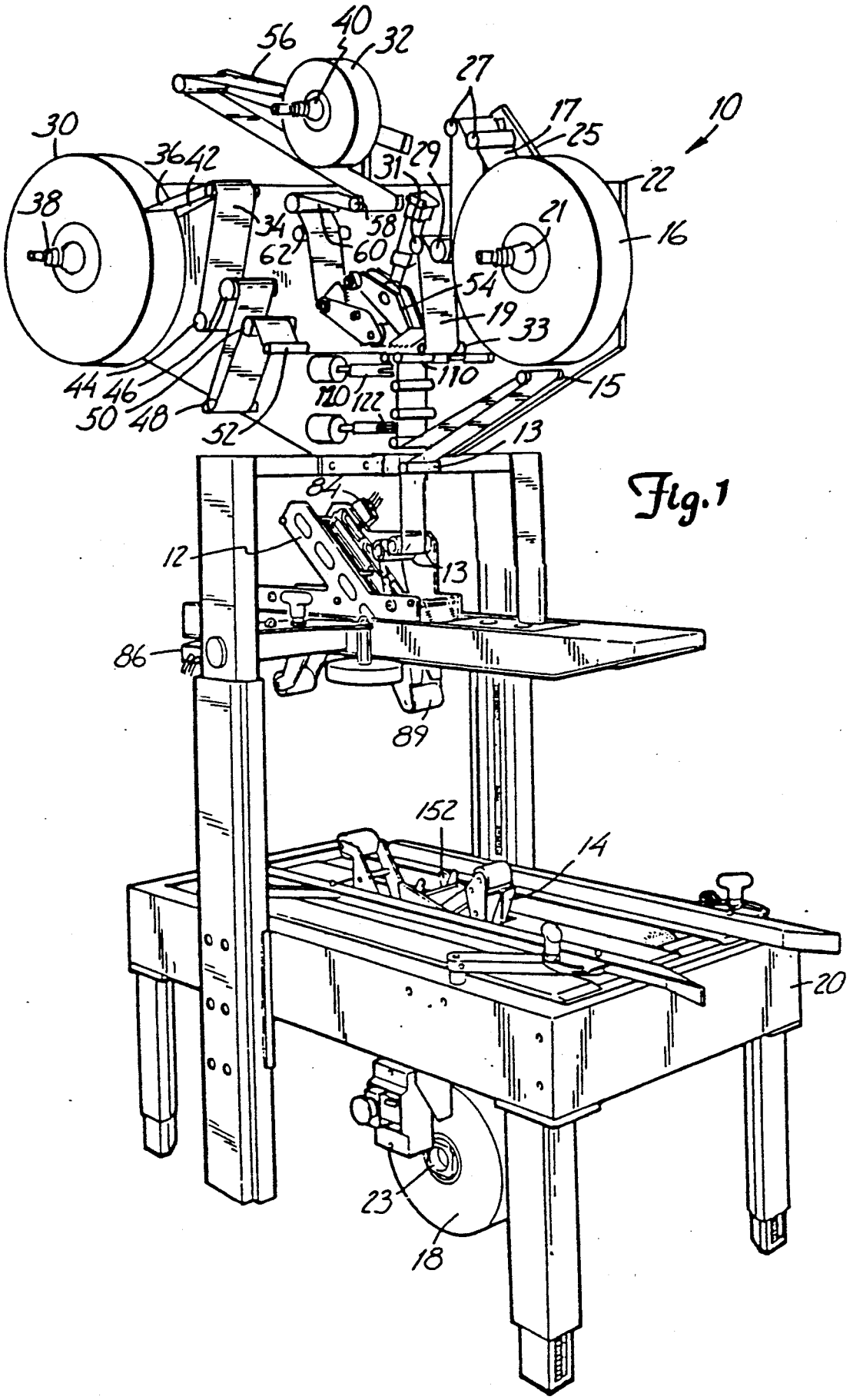
FIG. 1 is a perspective view of a tape handle forming apparatus of the present invention along with a box sealing system.

An apparatus generally indicated at 10 of the present invention is illustrated in FIG. 1. The apparatus 10 incorporates two tape-applying devices 12 and 14. The Deering, Jr. U.S. Pat. No. 4,238,269 describes a tape applying device having a linearly retractable application member that is suitable for use with the present invention and is hereby incorporated by reference. A commercially available example of an apparatus that can use the present invention is a taping head sold under the trademark ACCUGLIDE by Minnesota Mining and Manufacturing Company of St. Paul, Minn. The present invention may also be used with tape applying devices having pivotally mounted application members.

The devices 12 and 14 are positioned to apply lengths of pressure-sensitive adhesive coated tape from supply lengths of tape 16 and 18, respectively, held by spools 21 and 23, one after another around the exterior of an object such as a rectangular box 100 that travels along a predetermined path through the apparatus 10. The box 100 includes a first upright side 101, a second upright side 103 which is adjacent and generally perpendicular to said first side 101, and a third upright side 105 adjacent to said second side 103 and which is spaced from and generally parallel to said first side 101. Each length of box sealing tape 16 has a back side 17 and an adhesive side 19.

A path from the spool 21 to the box 100 is defined by a box sealing tape path which first includes a box sealing tape dancer arm 25. The box sealing tape 16 winds off the spool 21 over the box sealing tape dancer arm 25. The box sealing tape dancer arm 25 is spring biased and keeps the slack out of the box sealing tape 16 as the box sealing tape 16 works its way toward the box 100.

The box sealing tape path is further defined by the box sealing tape 16 winding off the spool 21 and over the box sealing tape dancer arm 25 where it loops around a plurality of initial rollers 27 before coming to a box sealing tape prestrip roller 29. The initial rollers 27 further assist in keeping the slack out of the box sealing tape 16 before the box sealing tape 16 reaches the box sealing tape prestrip roller 29. The box sealing tape prestrip roller 29 is a driven roller and is designed to only strip the box sealing tape 16 from the spool 21 when tension is present in the box sealing tape 16. Tension is provided by the box 100 moving through the apparatus 10 and pulling on the box sealing tape 16.

From the box sealing tape prestrip roller 29, the box sealing tape path continues as the box sealing tape 16 passes over a plurality of secondary rollers 31, 33. Like the initial rollers 27, the secondary rollers 31, 33 assist: in maintaining the box sealing tape 16 taut.

The box sealing tape 16 continues downwardly toward the box 100 along the box sealing tape path until the box sealing tape 16 reaches the box 100. Along the box sealing tape path, the box sealing tape 16 passes over a phasing roller 15. The phasing roller 15 keeps the box sealing tape 16 taut and the phasing roller 15 is adjustable depending on the size of box 100 being sealed. A plurality of additional rollers 13 keep the box sealing tape 16 in line as the box sealing tape 16 makes its way to the box 100.

The apparatus 10 includes a base portion 20 supporting the tape-applying device 14. A conveying mechanism is adapted to move a box 100 placed along the path and past the devices 12 and 14. The device 12 is supported by a vertically movable frame portion (not shown) that is adapted to move vertically to bring the uppermost device 12 into contact with the top surface portions of the box 100 while the box 100 is being moved through a apparatus 10.

The devices 12 and 14 of the apparatus 10 function in the same manner and have essentially the same parts. The device 12 is mounted to apply tape to a top side 99 of the box 100, the top side having a length. The device 14 is mounted to apply tape to a bottom surface of the box 100.

The device 14 includes a tape cutter 152 (FIG. 1) which severs the box sealing tape after a suitable length has been applied to the bottom of the box 100. Similarly, the device 12 has a tape cutter 150 which is shown schematically in FIGS. 11-14. The cutter 150 severes the box sealing tape 16 so that the box 100 can continue through the apparatus 10 and the box sealing tape 16 can begin taping a new box.

As seen in FIG. 1, the apparatus 10 includes a supply of handle tape 30 and a supply of deadening material 32 is provided. Each length of handle tape 30 has an adhesive side 34 and a back side 36. The handle tape 30 and the deadening material 32 are provided in coils which are rotatably mounted on spools 38, 40, respectively, which, in turn, are mounted on the frame 22. A path from the spool 38 to the box 100 is defined by a handle tape path which first includes a handle tape dancer arm 42. The handle tape 30 winds off the spool 38 over the handle tape dancer arm 42. The handle tape dancer arm 42 is spring biased and keeps the slack out of the handle tape 30 as the handle tape 30 works its way toward the box 100.

The handle tape path is further defined by the handle tape 30 winding off the spool 38 and over the handle tape dancer arm 42 where it loops around an initial roller 44 before coming to a handle tape feed roller 46. The initial roller 44 further assists in keeping the slack out of the handle tape 30 before the handle tape 30 reaches the handle tape feed roller 46. The handle tape feed roller 46 is a driven roller and is designed to only strip the handle tape 30 from the spool 38 when tension is present in the handle tape 30. Tension is provided by the box 100 moving through the apparatus 10 and pulling on the handle tape 30.

From the handle tape feed roller 46, the handle tape path continues as the handle tape 30 passes over a plurality of secondary rollers 48, 50, 52 before it reaches an attachment mechanism 54. Like the initial roller 44, the secondary rollers 48, 50, 52 assist in maintaining the roller tape 30 taut. The attachment mechanism 54 attaches the deadening material 32 to the handle tape 30 as detailed below.

A path from the spool 40 to the box 100 is defined by a deadening material path which first includes a deadening material dancer arm 56. The deadening material 32 winds off the spool 40 over the deadening material dancer arm 56. Like the handle tape dancer arm 42, the deadening material dancer arm 56 is spring biased and keeps the slack out of the deadening material 32 as the deadening material 32 works its way toward the box 100.

The deadening material path continues by the deadening material 32 being routed over a plurality of tension rollers 58, 60, 62 until it reaches the attachment mechanism 54. The tension rollers 58, 60, 62 assist in maintaining the deadening material 32 taut. Upon reaching the attachment mechanism, 54, the attachment mechanism 54 attaches the deadening material 32 to the handle tape 30 as detailed below.

The attachment mechanism 54 aligns the deadening material 32 with the adhesive side 34 of the handle tape 30. As best illustrated in FIGS. 2 and 3, the attachment mechanism 54 is movable between an initial position 64 (FIG. 2) and a secondary position 66 (FIG. 3).

The attachment mechanism 54 includes a main body 68, a retention mechanism 70 and a main body gear assembly 72 fixedly mounted to the main body 68. The main body 68 is pivotally mounted on the frame 22 through a pivot point (not shown). The retention mechanism 70 is mounted on the main body 68 and urges the deadening material 32 against an application roller 73 of the attachment mechanism 54 through the use of a pinching mechanism 74. The main body gear assembly 72 is designed to matingly join a corresponding compatible gear assembly 76 as discussed below.

The attachment mechanism 54 further comprises a blade arm 78 having a blade 80 mounted on one end thereof and a corresponding gear assembly 76 fixedly mounted at the other end thereof. The blade arm 78 is attached to an attachment mechanism activator 82.

Figure 2:
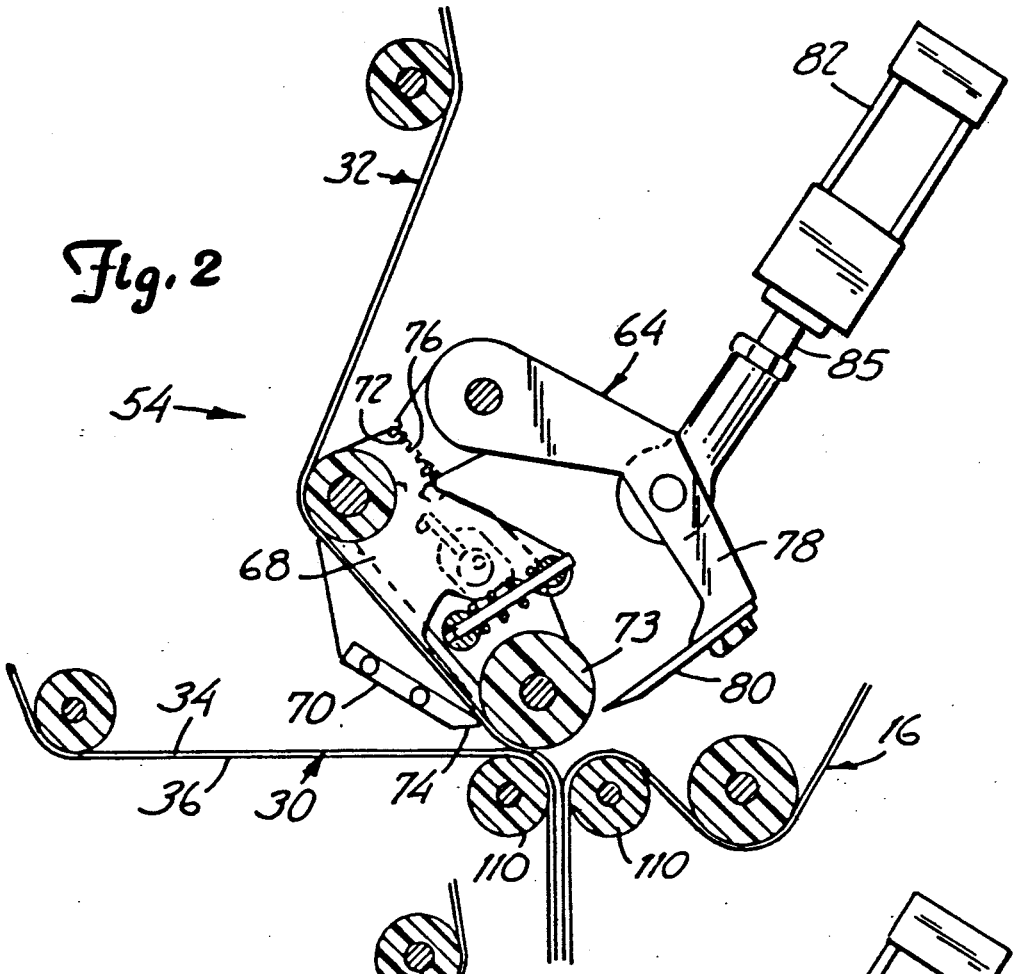
FIG. 2 is a side view of an attaching mechanism on the tape handle forming apparatus of the present invention, illustrating the mechanism in a state for mounting the deadening material onto the handle tape, with some parts broken away or shown in section.
Figure 3:
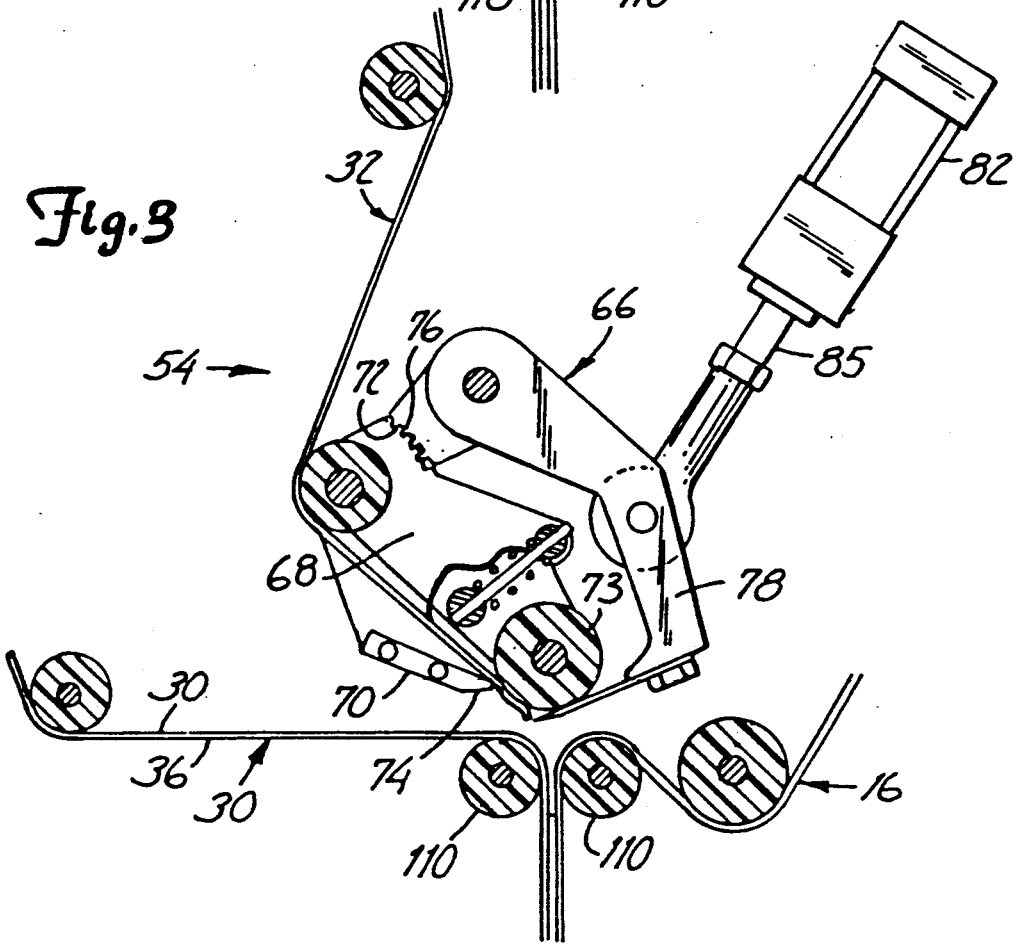
FIG. 3 is a side view of the attaching mechanism, illustrating the mechanism in a state for severing the deadening material, with some parts broken away or shown in section.

The blade arm 78 is movable between a first position as illustrated in FIG. 2 and a second position as illustrated in FIG. 3. The blade arm 78 is operably coupled with the main body 68 through the corresponding gear assembly 76 and the main body gear assembly 72 such that when the blade arm 78 is in its first position, the blade 80 is spaced away from the deadening material 32 and the attachment mechanism 54 is in its initial position 64 (FIG. 2) which urges (via application roller 73) the deadening material 32 against the adhesive side 34 of the handle tape 30. When the attachment mechanism is moved to its second position 66 (FIG. 3), the blade 80 is moved into its second position and severs the deadening material 32 into a length, thereby pulling the unsevered or remaining deadening material 32 away from the handle tape 30.

The movement of the attachment mechanism 54 between its initial position 64 and its secondary position 66 is activated through the attachment mechanism activator 82. As illustrated in FIG. 1, the attachment mechanism activator 82 is controlled by a plurality of switches 84, 86, namely a first switch 84 and a second switch 86. The first switch 84 is activated mechanically by the box 100 entering the apparatus 10 and forcing an application mechanism 89 into a taping position which activates the first switch 84. When the first switch 84 is activated, an extensible arm 85 of the activator 82 is retracted and moves the attachment mechanism 54 to its initial position 64. This process commences the application of the deadening material 32 to the adhesive side 34 of the handle tape 30. The blade arm 78, in response to the attachment mechanism 54 moving to its initial position 64, moves away from the deadening material 32 such that the blade 80 does not severe the deadening material 32.

As the box 100 leaves the apparatus 10, the second switch 86 is mechanically activated by the box 100. Upon activation of the second switch 86, the arm 85 of the activator 82 is extended to move the attachment mechanism 54 into its secondary position 66 and moves the deadening material 32 away from the handle tape 30. The remaining deadening material 32 is maintained within the attachment mechanism 54 by the pinching mechanism 74 such that a leading edge of the deadening material 32 is maintained in a ready fashion for the next box to activate the first switch 84. As the attachment mechanism 54 moves into its secondary position 66, the blade arm 78 moves towards the deadening material 32 and thereby allows the blade 80 to sever a discrete strip of the deadening material 32 from the supply thereof.

Figure 6:
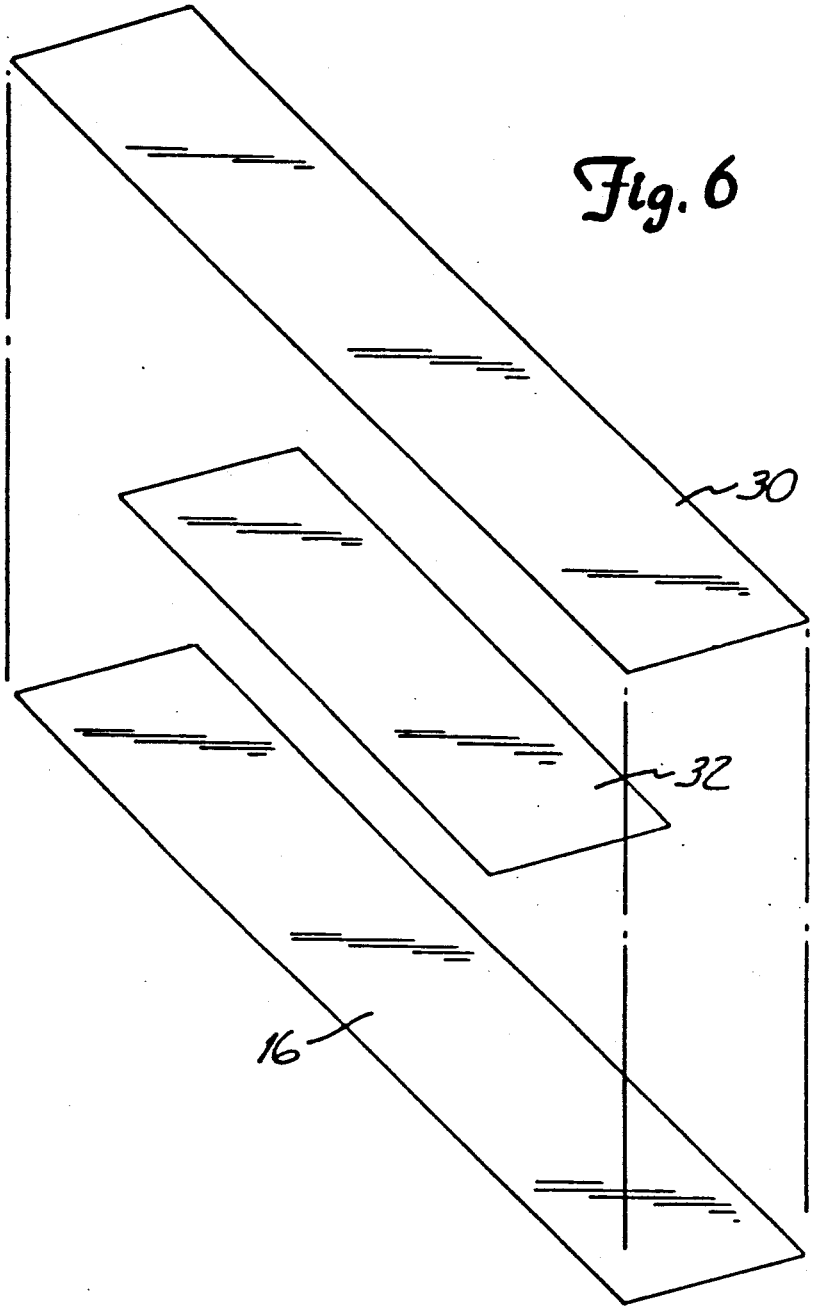
FIG. 6 is an exploded view showing the box sealing tape, the deadening material and the handle tape components of the tape handle of the present invention.

The strip of deadening material 32 is severed into a length shorter than the length of the handle tape 30. As illustrated in FIGS. 4, 5 and 6, the combined deadening material 32 and handle tape 30 forms a handle assembly 88 having first and second adhesive sections 90 and 92 and an intermediate adhesive masked section 94. The first and second adhesive sections 90 and 92 are adhered to the box sealing tape 16 on the box 100 as described further below.

The first switch 84 and the second switch 86 permits the cutting of a length of deadening material 32 which may be approximately two inches less than the length of the top side 99 of the box 100. The first switch 84 and the second switch 86 are triggered by the box 100 moving through the apparatus 100 and control the length of the deadening material 32 depending on the length of the box 100. Therefore, as illustrated in FIG. 4, the deadening material 32 will be attached to the adhesive side 34 of the handle tape 30 so that upon application to the box 100, the end edges of the deadening material are preferably spaced from each edge 102, 104 of the top side 99 of the box 100 (e.g., a spacing of one inch).

Once the deadening material 32 is applied to the adhesive side 34 of the handle tape 30, the first and second adhesive sections 90 and 92 of the handle tape 30 are applied to the back side 17 of the box sealing tape 16 such that the handle tape 30 lies generally flush, but not taut, to the box sealing tape 16. The handle tape 30 is not taut to assist in a person being able to put his hand between the handle tape 30 and the box sealing tape 12 in order to assist in carrying the box.

To facilitate this process, the box sealing tape 16 and the handle tape 30, with the deadening material 32 adhered to the adhesive side 34 of the handle tape 30, passes through a plurality of pinch or nip rollers 110 (see FIGS. 1, 2 and 3). The nip rollers 110 are spaced apart such that when the handle tape 32 and the box sealing tape 16 pass through a nip defined by the nip rollers 110, the first and second adhesive sections 90 and 92 of the handle tape 30 are urged against the back side 17 of the box sealing tape 16 to adhere thereto.

Each strip of combined box sealing tape 16, handle tape 30 and deadening material 32, applied to each box 100 will have approximately seven and one-half inches without deadening material 32 attached (a section of three and three-quarters inches at each end of the combination). It is also within the scope of the present invention to have the deadening material 32 have a length equal to the length of the top side 99 of the box 100, thereby extending from one edge 102 to the other edge 104. By having the deadening material equal in length to the top side 99, the first and second adhesive sections 90 and 92 are adhered only to the box sealing tape 16 which is adhered to opposed, substantially parallel sides of the box.

The handle tape 30 will not adhere to the box sealing tape 16 where the deadening material 32 is present simply because the deadening material 32 has covered the adhesive over that portion of the handle tape 30. This provides for the handle tape 30 to be free from the box sealing tape 16 thereby forming a handle 112 when the box sealing tape 16 is adhered to the box 100 as illustrated in FIG. 4.

The box sealing tape 16 preferably has a longitudinal side edge 114, as shown in phantom in FIG. 5, wherein the handle assembly 88, as applied to the box sealing tape 16, is slightly wider than the box sealing tape 16. It should be noted that the handle assembly 88 can also be the same width or narrower than the box sealing tape 16 so long as a portion of the handle assembly 88 laterally overhangs the box sealing tape 16. The handle assembly 88 can also laterally overhang the box sealing tape 16 on only one lateral side or on both lateral sides of the box sealing tape 16. By providing this offset, the first adhesive section 90 has a first edge portion 91 which overlies the side edge 114 of the box sealing tape 16 and the second adhesive section 92 has a second edge portion 93 which overlies the side edge 114 of the box sealing tape 16.

Now referring back to FIG. 1, the apparatus 10 further includes a first folding mechanism 120 and a second folding mechanism 122. Although the apparatus 10 of the present invention preferably includes two folding mechanisms 120, 122, reference will be made only to the first folding mechanism 120. It should be understood that the second folding mechanism 122 operates in the same manner. It should also be understood that the scope of the present invention includes four folding mechanisms such that the folds can be made on both sides of the tape simultaneously. Operation of a folding mechanism is discussed in detail below.

Figure 7:
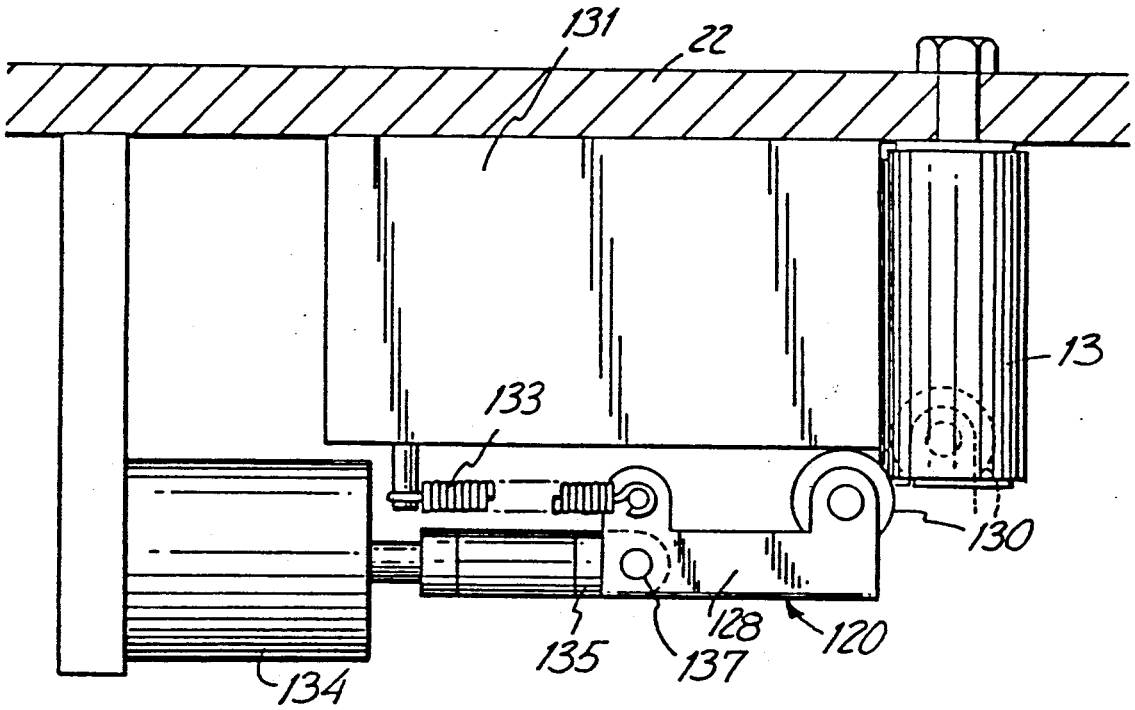
FIG. 7 is a top view of a tape folding mechanism of the present invention.
Figure 8:
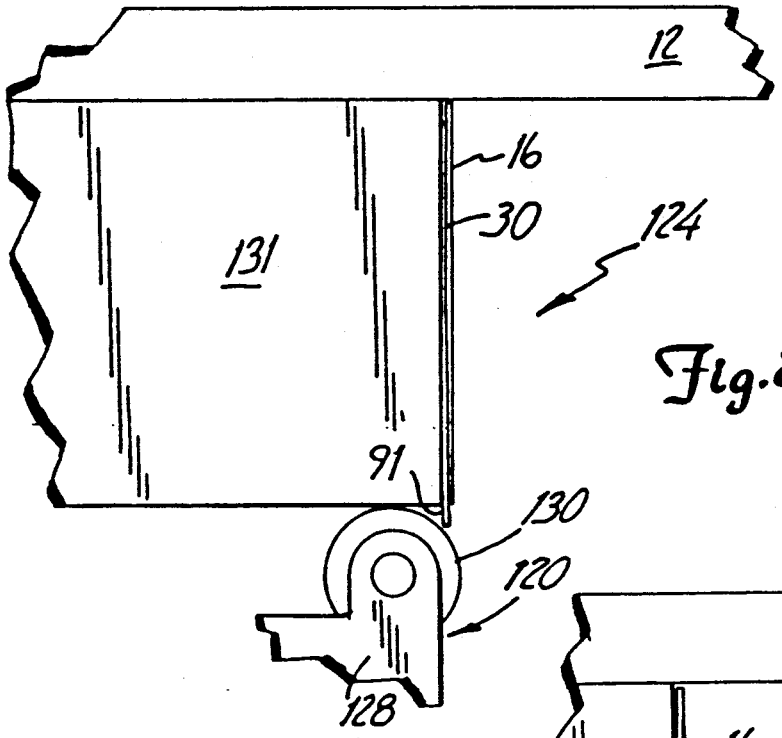
FIGS. 8, 9A and 9B are top views showing the tape engaging roller of the folding mechanism in its two operative positions.
Figure 9A:
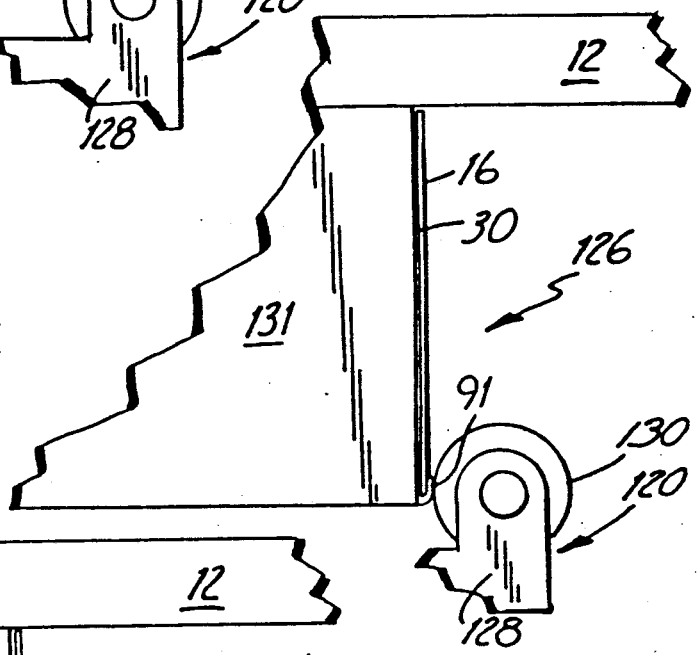

The folding mechanism 120 is illustrated in FIGS. 7, 8, 9A and 9B. The folding mechanism 120 has a first retracted position 124 (FIG. 8) and a second operable position 126 (FIG. 9A). The folding mechanism 120 is provided to fold the edge portions 91 and 93 over and into engagement with the adhesive side 19 of the box sealing tape 16, as illustrated in FIG. 9A. The folding mechanism 120 includes a folding arm 128, a roller 130 and a spring 133. The roller 130 is attached to a free end of the folding arm 128 and rolls on a platen 131 which is attached to the frame 22. Additionally, the roller 130 is adapted to engage the first and second edge portions 91 and 93 thereby folding the first and second edge portions 91 and 93 onto the adhesive side 19 of the box sealing tape 16. The spring 133 biases the folding arm 120 around the end of the platen 131 to further urge the roller 130 into contact with the first 91 and second 93 edge portions, as illustrated in FIG. 9A.

The folding mechanism 120 is activated through an actuator or air cylinder 134, as illustrated in FIG. 7, by the activation of the first switch 84 as discussed above. The air cylinder 134 includes an extensible arm 135 pivotally attached to the folding arm 128 through a pivot pin 137. At the beginning of a folding cycle, the folding mechanism 120 is in its second operable position 126 (See FIG. 9A).

Figure 9B:
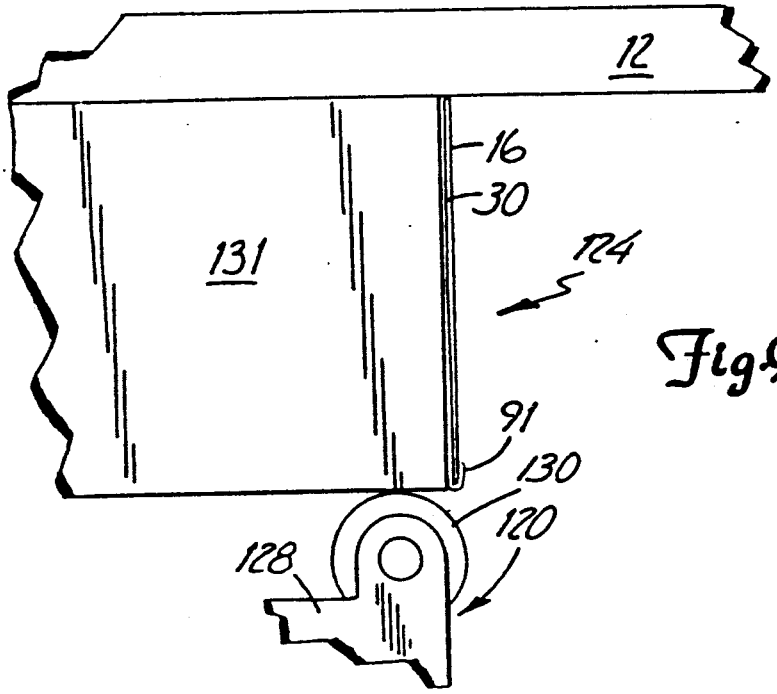

When the first switch 84 is activated, the arm 135 is retracted into the air cylinder 134 to move the folding mechanism 120 into its first retracted position 124, as illustrated in FIG. 9B, away from the first and second edge portions 91 and 93 (in FIGS. 8, 9A and 9B, only edge portion 91 is illustrated). The folding mechanism 120 is retracted completely to the first retracted position 124 before the handle tape 30 and the box sealing tape 16 are advanced.

FIG. 9B illustrates the folding mechanism 120 in its first retracted position 124 after the folding mechanism 120 has retracted and before the handle tape 32 and the box sealing tape 16 begin to travel down their respective paths towards the box 100.

The second switch 86 is contacted by the trailing edge of the box 100 as the box 100 is travelling through the apparatus 10. This contact causes the deadening material 32 to be severed and thus stop being applied to the handle tape 16. The severing of the deadening tape 32 occurs before the folding mechanism extends to its second operable position 126.

Figure 10:
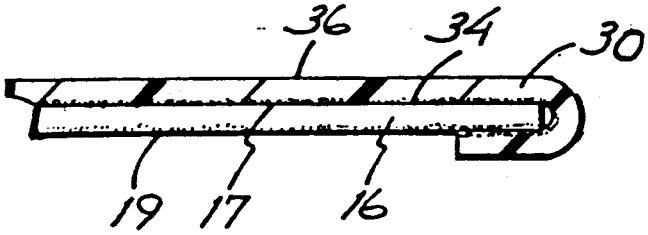
FIG. 10 is a sectional view of as taken along line 10—10 in FIG. 5.

When the box 100 is completely through the apparatus 10 the handle tape 32 and the box sealing tape 16 cease moving down their respective paths towards the box 100. The first switch 84 is once again activated by the application mechanism 89 as the application mechanism 89 returns to a rest position which causes the folding mechanism to extend to its second operable position 126. The extensible arm 135 is extended from the air cylinder 134 and causes the folding arm 120 to move toward the combination of the handle tape 30 and the box sealing tape 16. The folding arm then moves the roller 130 into contact with the first and second edge portions 91 and 93 and then the spring 133 causes the roller 130 to fold the first and second edge portions 91 and 93 into contact with the adhesive side 19 of the box sealing tape 16, as illustrated in FIG. 10, giving a first and a second folded portion 136 and 138, as illustrated in FIGS. 4 and 5.

The box sealing tape 16, the handle tape 30 and the deadening material 32 is then attached to the box 100 as illustrated in FIGS. 11-14. The combination creates a handle 112 for carrying the box 100.

Figure 11:
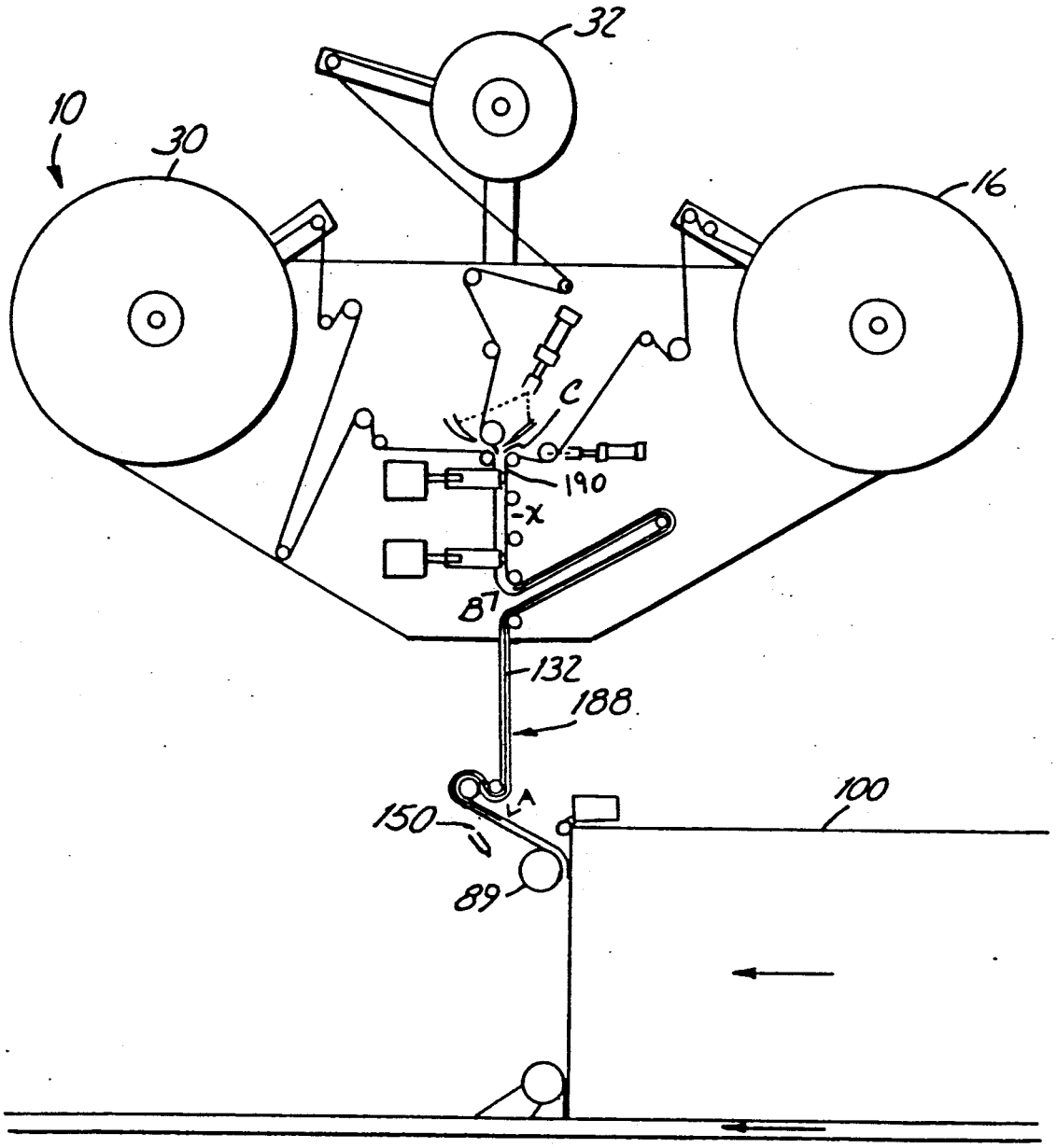
FIGS. 11-14 are schematic views of the inventive apparatus showing its sequence of operation in forming and applying a tape handle to a box.

FIGS. 11-14 illustrate the sequence of applying the handle assembly to a box. In particular, FIG. 11 illustrates a leading handle assembly 188 as the leading handle assembly 188 begins being applied to a box 100. The leading handle assembly 188 is applied to the box 100 by the application mechanism 89 with the leading handle assembly 188 thereunder so that the adhesive side of the leading handle assembly 188 is in contact with the box 100.

As the leading handle assembly 188 is beginning to be applied, a second handle assembly 190 is already beginning its way down the path towards the box 100. The beginning of the deadening material 132 for the leading handle assembly 188 is denoted at A while the end of the deadening material 132 for the leading handle assembly 188 is denoted at B. The end of the leading handle assembly 188 and the beginning of the second handle assembly 190 is denoted at X. The leading handle assembly 188 will be severed from the second handle assembly 190 at point X by tape cutter 150. The severance of tape after it has been applied to a box is well known in the art. At X, the severance creates the beginning of the second handle assembly 190. The beginning of deadening material 134 for the second handle assembly 190 is denoted at C.

Figure 12:
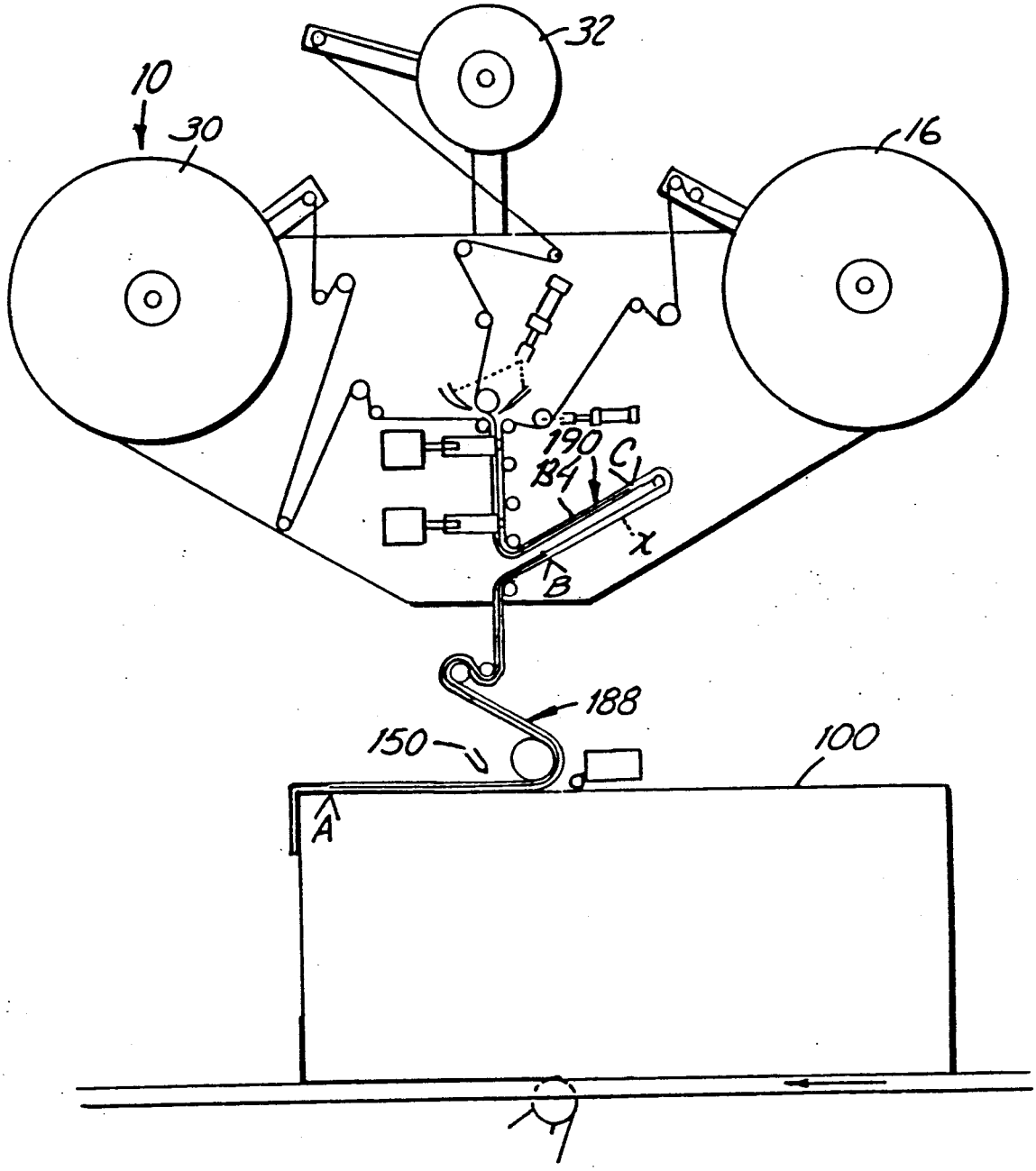

In FIG. 12, the box 100 has advanced and is approximately one-third through the apparatus 10. As the box 100 advances, the leading handle assembly 188 is pulled along the path towards the box 100. The leading handle assembly 188 has already been applied to the box 100 on a perpendicular side and a portion of the top side along the seam. As the leading handle assembly 188 follows the path towards the box 100, the second handle assembly 190 has also continued along the same path with the severing point denoted at X. The beginning of the deadening material 134 for the second handle assembly 190 is denoted at C. The ending point for the deadening material 134 for the second handle assembly 190 has not yet been reached as viewed in FIG. 12. The preferred distance between point B and point C is approximately seven and one-half inches, however, other distances may be used depending on the size and shape of the box being used.

Figure 13:
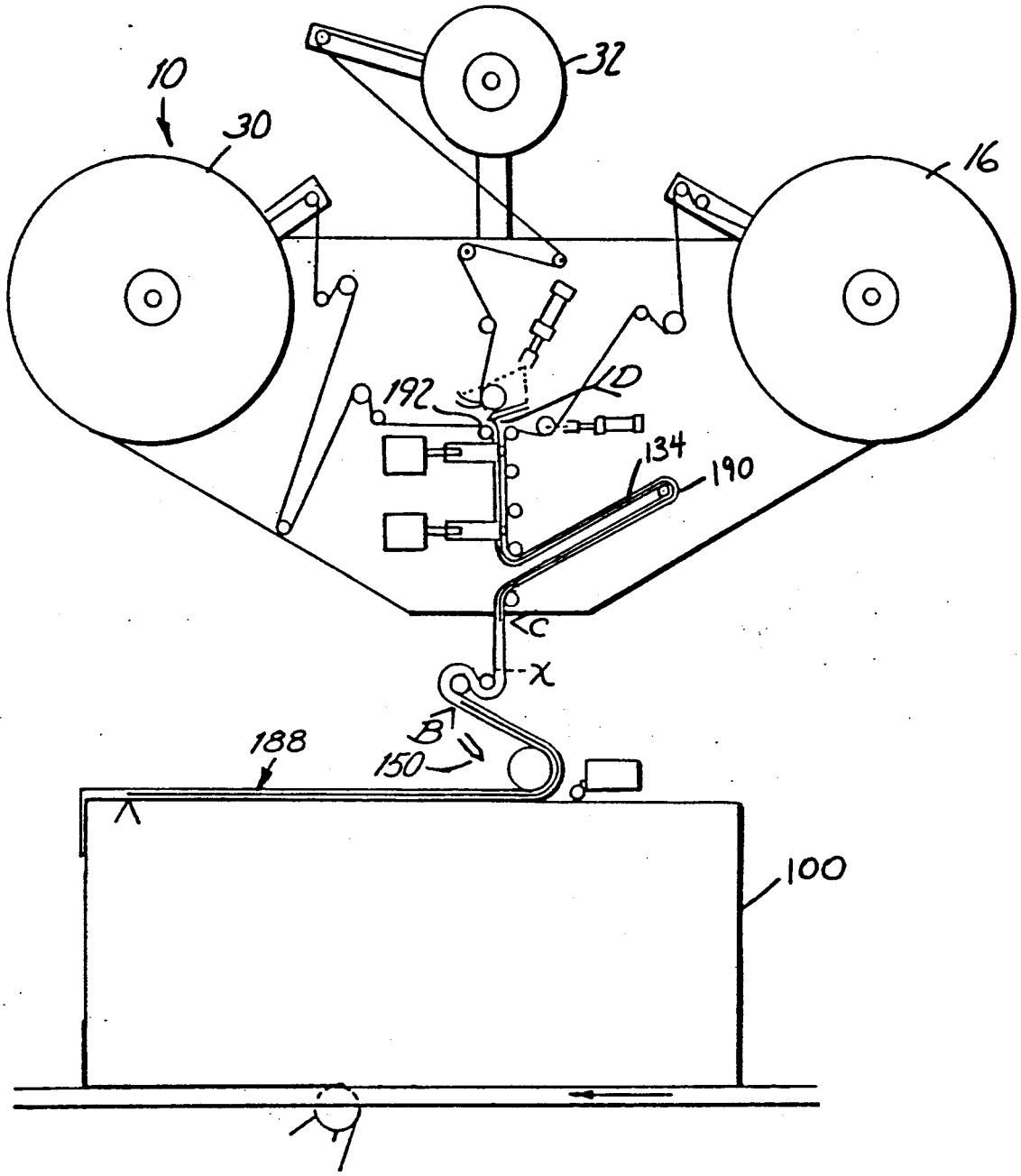

In FIG. 13, the box 100 and the handle assembly 188 has once again advanced along with the second handle assembly 190. At this stage, the box 100 is approximately two-thirds through the apparatus 10. The deadening material 134 for the second handle assembly 190 has been severed from the remaining deadening material at point D.

Figure 14:
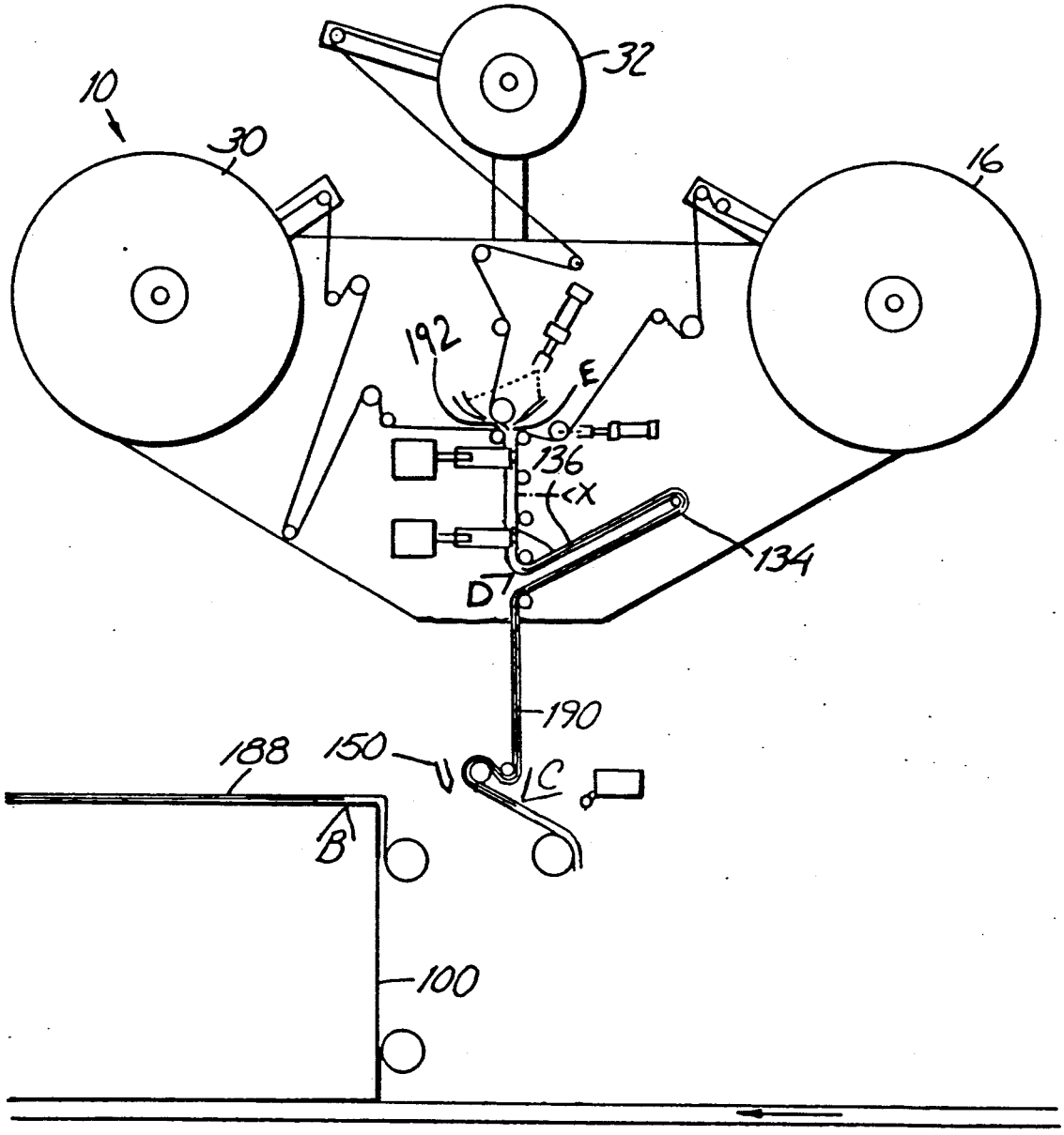

FIG. 14 illustrates the placement of the leading handle assembly 188 as the box 100 leaves the apparatus 10. Deadening material 136 for a third handle assembly 192 is beginning to be applied to the third handle assembly 192 at point E. Point X' denotes the severing point between the second handle assembly 190 and the third handle assembly 192.

The leading handle assembly 188 has been severed from the second handle assembly 190 such that the leading handle assembly 188 is now completely separate from the second handle assembly 190 and the leading handle assembly 188 is attached to the box. The end of the deadening material 134 of the second handle assembly 190 is denoted at D while the beginning of the deadening material 136 of the third handle assembly 190 is denoted at E. Once again, the second handle assembly 190 and the third handle assembly 192 are severed at point X' and the distance between D and E is approximately seven and one-half inches depending on the size and the shape of the box.

At this point, when the handle tape 30 and the box sealing tape 16 have stopped proceeding down their respective paths, the folding mechanisms 120 and 122 are activated to simultaneously fold over the second edge of the second handle assembly 190 and the first edge of the third handle assembly 192. The folding mechanisms 120 and 122 are activated by the switch 84, as discussed above.

As mentioned previously, the first and second edge portions 91 and 93 are folded under the edge of the box sealing tape 16 prior to the box sealing tape 16 being applied to the box 100. Preferably, the box sealing tape 16 is adhered to adjacent, generally perpendicular sides of the box 100 such that portions of each of the first and second adhesive sections 90 and 92 of the handle assembly 88 overlie adjacent, generally perpendicular sides of the box 100 and the box sealing tape 16 is aligned longitudinally over a seam 113 between two opposed flaps 115, 117 of the box 100. In addition, it is preferable that each folded edge portion 136, 138 overlies adjacent, generally perpendicular sides of the box 100 and that each folded edge portion 136, 138 is placed over the edges 104, 102, respectively.

In the preferred embodiment, the handle assembly 88 lays flush against the box 100 as illustrated in FIG. 4. This allows multiple boxes to be stacked without the handles 112 protruding from between the boxes. In addition, preferably, the deadening material 32 is selected from the group consisting of film, single coated tape and paper.

Figure 15:
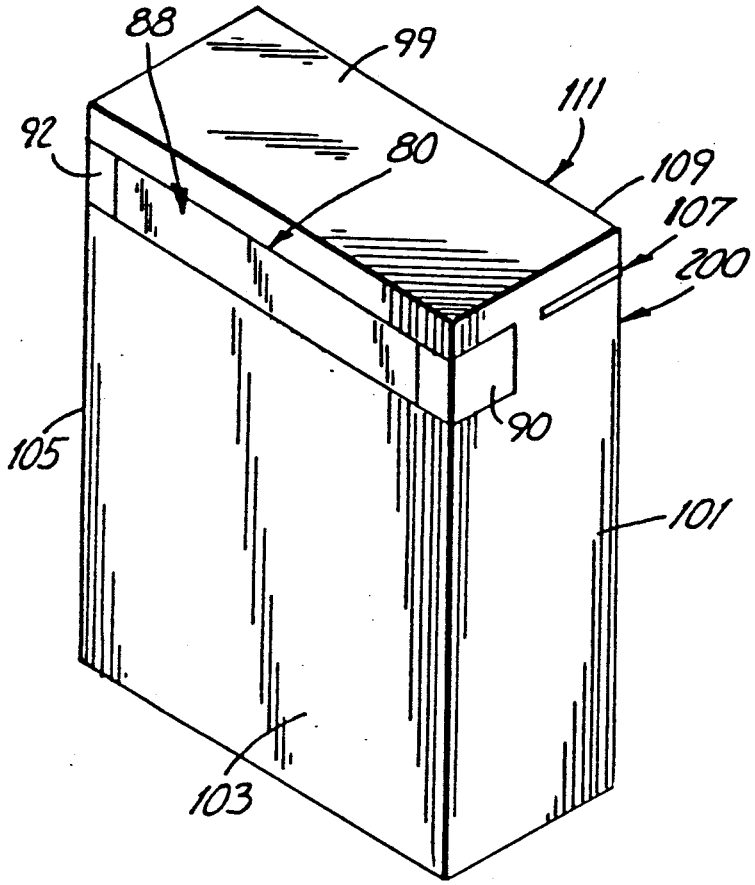
FIGS. 15 and 16 is a perspective view of a second embodiment tape handle of the present invention attached to a box.
Figure 16:
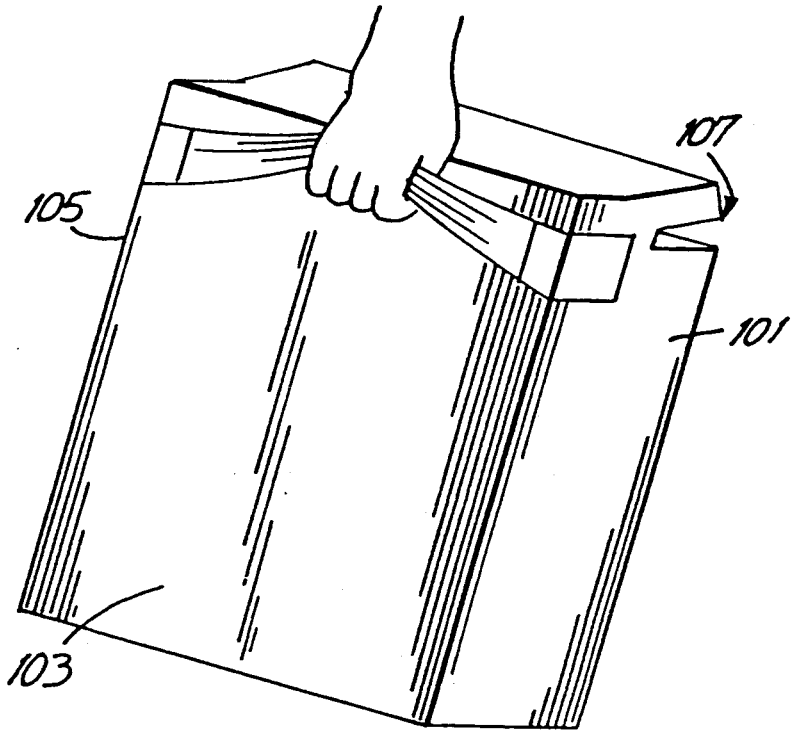

As best illustrated in FIGS. 15 and 16, in a box 200 having a pour opening 107 adjacent a top edge 109 of a pour side 111, the handle assembly 88 can be mounted along the sides of the box 200, adjacent the top side 99 thereof. In this configuration, the first adhesive section 90 is adhered to the first side 101 of the box 200, the masked section 94 lies generally flush along the second side 103 of the box 200 and the second adhesive section 92 is adhered to the third side 105 of the box 200, as illustrated in FIGS. 15 and 16. The first side 101 is opposed and substantially parallel to the third side 105. The second side 103 is intermediate to the first side 101 and the third side 105 and is opposed to the side of the box 200 having the pour opening 107.

The handle assembly 88 further is preferably mounted to an upper portion of the box 200 to assist in lifting the box 200 for pouring out its contents through the pour opening 107. Furthermore, it is preferred that the handle assembly 88 is mounted no lower than one third of the height of the box 200 from its top side 99. When using the handle assembly 88 for a box 200 with a pour opening, the first and second adhesive sections 90 and 92 are not attached to any box sealing tape, but instead are applied directly to the box 200.

According to the present invention, the length of the handle on any given box can be varied depending on the size of the box and the contents of the box. The taping apparatus can be adjusted to tape any given length of box. The length of deadening material on any given handle may be adjusted to provide for a larger or a smaller handle.

Although the present invention has been described with reference to preferred embodiments, workers skilled in the art will recognize that changes may be made in form and detail without departing from the spirit and scope of the invention.

What is claimed is:

1. A method for forming tape handles for boxes, the method for forming each tape handle comprising the steps of:

providing a strip of box sealing tape having an adhesive side and a back side;

providing a strip of handle tape having an adhesive side and a back side;

providing a strip of deadening material, with the strip of deadening material being shorter in length than the handle tape;

positioning the strip of deadening material on the adhesive side of the handle tape thereby forming a handle assembly having first and second adhesive sections and an intermediate masked section; and adhering the first and second adhesive sections of the handle assembly to the back side of the box sealing tape.

2. The method of claim 1 wherein the box sealing tape has a longitudinal side edge and further comprising the steps of:

laterally overhanging the handle assembly from the box sealing tape so that the first adhesive section has a first edge portion which overlies the side edge of the box sealing tape and the second adhesive section has a second edge portion which overlies the side edge of the box sealing tape; and folding at least a portion of the first and second edge portions under the side edge of the box sealing tape.

3. The method of claim 2 and further comprising the step of:

pressing the first and second edge portions which are folded under the side edge of the box sealing tape against the adhesive side of the box sealing tape.

4. The method of claim 3 and further comprising the step of:

aligning each folded edge portion to overlie an edge of the box along adjacent sides thereof.

5. A method for forming and applying tape handles to boxes, the method comprising the steps of:

providing a strip of box sealing tape having an adhesive side and a back side;

providing a strip of handle tape having an adhesive side and a back side;

providing a strip of deadening material, with the strip of deadening material being shorter in length than the handle tape;

positioning the strip of deadening material on the adhesive side of the handle tape thereby forming a handle assembly having first and second adhesive sections and an intermediate masked section;

adhering the first and second adhesive sections of the handle assembly to the back side of the box sealing tape; and adhering the box sealing tape to a box.

6. The method of claim 5, and further comprising the step of:

aligning the box sealing tape and the handle assembly such that end portions of the box sealing tape are adhered to opposed, substantially parallel sides of the box.

7. The method of claim 6 and further comprising the step of:

aligning the box sealing tape and the handle assembly such that each of the first and second adhesive sections of the handle assembly overlies at least one edge along adjacent sides of the box.

8. The method of claim 5, and further comprising the step of:

aligning the box sealing tape longitudinally over a seam between two opposed flaps of the box.

9. The method of claim 5 wherein the strips of box sealing tape and handle tape are provided from continuous webs of box sealing tape and handle tape, respectively, and further comprising the step of:

defining the strips of box sealing tape and handle tape by severing the strips from their respective continuous webs after the handle assembly has been adhered to the box sealing tape.

10. The method of claim 9, and further comprising:

repeating the above steps to sequentially form and mount a tape handle on each of a series of boxes.

11. The method of claim 10, and further comprising the steps of:

laterally overhanging the handle assembly for each box sealing tape so that the first adhesive section of that handle assembly has a first edge portion which overlies the side edge of the strip of box sealing tape and the second adhesive section has a second edge portion which overlies the side edge of the strip of box sealing tape.

12. The method of claim 11, and further comprising the step of:

simultaneously folding at least a portion of the second edge portion of the tape handle and at least a portion of the first edge portion of a next adjacent tape handle under the side edge of their respective strips of box sealing tape.

13. The method of claim 9 wherein the strip of deadening material is provided from a continuous web of deadening material, and further comprising:

severing the strip of deadening material from the continuous web of deadening material after the strip of deadening material has been positioned relative to the handle tape.

14. An apparatus for forming and applying tape handles onto boxes which are moving in a continuous row past the apparatus, the apparatus comprising:

a frame;

a source of handle tape having an adhesive side and a back side, supported by the frame;

a source of deadening material, supported by the frame;

a first cutter device operably supported by the frame for severing a first length of deadening material from the source of deadening material;

a first assembly operably supported by the frame for urging the first length of deadening material against the adhesive side of a second, longer length of the handle tape so that a handle assembly of said second length is defined having first and second adhesive sections and an intermediate adhesive masked section, with the handle assembly having a free leading edge and a trailing edge connected to the source of handle tape;

a second assembly operably supported by the frame for aligning the leading edge of the handle assembly with a box and urging the first adhesive section thereof against a first side of the box, the masked section thereof generally flush along a second side of the box, and the second adhesive section thereof against a third side of the box which is generally parallel to and spaced from said first side;

a second cutter device operably supported by the frame for severing the handle assembly form the source of handle tape along its trailing edge;

a source of box sealing tape having an adhesive side and a back side, supported by the frame;

means for feeding the box sealing tape to the first assembly;

wherein the first assembly further urges the first and second adhesive sections of the handle assembly against the back side of a length of the box sealing tape so that the handle assembly is adhered to said length of the box sealing tape and lies generally flush thereto;

wherein the second assembly applies the handle assembly to the box with the box sealing tape thereunder so that the adhesive side of the box sealing tape is in contact with the box; and wherein the second cutter device further severs the length of the box sealing tape from the source thereof.

15. The apparatus of claim 14 wherein the first cutter device includes an attaching mechanism movable between an initial position and a secondary position, a blade movable between a first position and a second position, and means for moving the blade, with the blade being operably coupled to the attaching mechanism so that when the blade is in its first position, the blade is spaced from the source of deadening material and the attachment mechanism is in its initial position which urges a defined length of deadening material against the adhesive side of the handle tape, and so that when the blade is in its second position, the blade severs the deadening material from the source thereof and the attachment mechanism is in its secondary position which urges the source of the deadening material away from the handle tape.

16. The apparatus of claim 14 wherein the first assembly includes a pair of generally parallel rollers aligned such that when the handle tape and the box sealing tape pass through a nip defined by the rollers, the first and second adhesive sections of the handle tape adhere to the back side of the box sealing tape.

17. The apparatus of claim 14 wherein the box sealing tape has a longitudinal side edge and wherein the handle assembly, as applied to the box sealing tape, is laterally overlap from the box sealing tape so that the first adhesive section has a first edge portion which overlies the side edge of the box sealing tape and the second adhesive section has a second edge portion which overlies the side edge of the box sealing tape and wherein the first assembly includes means for engaging one of the edge portions and bending at least a portion of it over and into engagement with the adhesive side of the box sealing tape.

18. The apparatus of claim 14 wherein each handle assembly, as applied to the length of box sealing tape, defines a discrete tape handle for application to a box, and wherein a first leading tape handle is applied to a first box and a trailing second tape handle is applied to a next box and so on, with the second cutter device defining the length of each handle and cutting adjacent handles apart along a line defining the separation between the second adhesive section of the leading handle and the first adhesive section of the trailing handle, with the trailing handle still being connected to the sources of handle tape and box sealing tape.

19. The apparatus of claim 18 wherein the box sealing tape has a longitudinal side edge and wherein each handle assembly, as applied to its respective length of box sealing tape, laterally overlaps the box sealing tape so that the first adhesive section has a first edge portion which overlies the side edge of the box sealing tape and wherein the first assembly includes means for engaging the second edge portion of the leading handle and the first edge portion of the trailing handle to bend discrete segments of those portions over and into engagement with the adhesive side of the box sealing tape for each handle.

20. The apparatus of claim 19 wherein the second assembly applies each handle to its respective box so that the bent-over segments of the first and second adhesive portions of the handle assembly are each aligned over a side edge of the box.

21. The apparatus of claim 17 wherein the engaging means has a roller which is movable between a first retracted position spaced from the box sealing tape and handle assembly adhered thereto and a second operable position wherein the roller engages said one of the edge portions thereby folding at least a portion of said edge portion onto the adhesive side of the box sealing tape.

22. The apparatus of claim 21 wherein the engaging means further includes a support arm for the roller and means for urging the support arm away from the first and second edge portions to a state where the roller is in its first retracted position.

23. The apparatus of claim 22 wherein the engaging means includes an actuator for selectively moving the support arm toward the first and second edge portions to a state where the roller is in its second operable position.

24. The apparatus of claim 23, and further comprising:

switch means supported on the frame for activating the actuator to move the roller to its second operable position, dependent upon the position of a box relative to the frame.

25. In combination with a box sealing tape applicator which aligns a continuous web of box sealing tape with a seam to be sealed along one side of a box, applies the box sealing tape longitudinally across the seam and cuts the box sealing tape to a desired length so that end portions thereof are adhered to opposed, substantially parallel sides of the box, an apparatus for applying a tape handle assembly onto the length of box sealing tape which comprises:

means for providing a strip of handle tape having an adhesive side and a back side;

means for providing a strip of deadening material, the deadening material being shorter in length than the handle tape;

means for positioning the deadening strip on the adhesive side of the handle tape thereby forming a handle assembly having first and second adhesive sections and an intermediate masked section; and means for adhering the first and second adhesive sections of the handle assembly to the back side of the box sealing tape.

26. The apparatus of claim 25 wherein the strip of deadening material is formed from a continuous web of such material and wherein the means for positioning the strip of deadening material on the adhesive side of the handle tape includes an attaching mechanism movable between an initial position and a secondary position, a blade movable between a first position and a second position, and means for moving the blade, with the blade being operably coupled to the attaching mechanism so that when the blade is in its first position, the blade is spaced from the web of deadening material and the attachment mechanism is in its initial position which urges the strip of deadening material against the adhesive side of the handle tape, and so that when the blade is in its second position, the blade severs the strip of deadening material from the web and the attachment mechanism is in its secondary position which urges the web of deadening material away from the handle tape.

27. The apparatus of claim 25 wherein the means for adhering includes a pair of generally parallel rollers aligned such that when the handle tape and the box sealing tape pass through a nip defined by the rollers, the first and second adhesive sections of the handle assembly adhere to the back side of the box sealing tape.

28. The apparatus of claim 25 wherein the box sealing tape has a longitudinal side edge and wherein the handle assembly, as applied to the box sealing tape, laterally overlaps the box sealing tape so that the first adhesive section has a first edge portion which overlies the side edge of the box sealing tape and the second adhesive section has a second edge portion which overlies the side edge of the box sealing tape and wherein the means for adhering includes means for engaging one of the edge portions and bends at least a portion of it over and into engagement with the adhesive side of the box sealing tape.

29. The apparatus of claim 28 wherein the engaging means has a roller which is movable between a first retracted position and a second operable position wherein the roller engages the said one edge portion thereby folding at least a portion of that edge portion onto the adhesive side of the box sealing tape.

30. The apparatus of claim 29 wherein the engaging means further includes a support arm for the roller and means for urging the support arm away from the first and second edge portions to a state where the roller is in its first retracted position.

31. The apparatus of claim 30 wherein the engaging means includes an actuator for selectively moving the support arm toward the first and second edge portions to a state where the roller is in its second operable position.

32. The apparatus of claim 31, and further comprising:

switch means supported on the frame for activating the actuator to move the roller to its second operable position, dependent upon the position of a box relative to the frame.

33. An apparatus for sealing boxes which are moved in a continuous row past the apparatus and for simultaneously applying a tape handle to each box, the apparatus comprising:

a frame;

a source of box sealing tape having an adhesive side and a back side, supported by the frame;

a box sealing tape applicator assembly operably supported by the frame for aligning a leading edge of the box sealing tape with a box and for urging a first end portion of the box sealing tape against a first side of the box, an intermediate portion of the box sealing tape against a second side of the box, and a second end portion of the box sealing tape, which terminates at a trailing edge, against a third side of the box, wherein the third side is generally parallel to and spaced from the first side;

a box tape cutter device operably supported by the frame for severing a length of box sealing tape for each box from the source thereof along the trailing edge of the length;

a source of handle tape having an adhesive side and a back side, supported by the frame;

a source of deadening material, supported by the frame;

a deadening material cutter device operably supported by the frame for severing a first length of deadening material from the source thereof;

a handle forming assembly supported by the frame which, prior to the box sealing tape being applied to the box and severed from its source, forms a tape handle by urging the adhesive side of the handle tape against the back side of the box sealing tape with the deadening material therebetween so that each tape handle so formed has first and second end portions wherein the handle tape is adhered to the box sealing tape and an intermediate portion wherein the deadening material prevents adherence of the handle tape and box sealing tape; and wherein the box sealing tape applicator applies the handle tape and deadening material along with the box sealing tape and wherein the box sealing tape cutter device severs the handle tape adhered to the box sealing tape from the source of handle tape and to a length equal to the length of the box sealing tape for each box.

* * * * *

UNITED STATES PATENT AND TRADEMARK OFFICE

CERTIFICATE OF CORRECTION

PATENT NO. : 5,079,900

DATED : January 14, 1992

INVENTOR(S) : KEITH T. PINCKNEY, THOMAS W. SEABOLD, MICHAEL C. FAUST

It is certified that error appears in the above-identified patent and that said Letters Patent is hereby corrected as shown below:

Col. 11, Line 60, after "box", insert "from its respective strip of box"

Col. 12, line 42, delete "form", insert "from"

Col. 16, Line 5, after "box", insert "sealing"

Signed and Sealed this

Twenty-seventh Day of April, 1993

*Attest:*

MICHAEL K. KIRK

*Attesting Officer*

*Acting Commissioner of Patents and Trademarks*

UNITED STATES PATENT AND TRADEMARK OFFICE

CERTIFICATE OF CORRECTION

PATENT NO. : 5,079,900

DATED : January 14, 1992

INVENTOR(S) : Pinckney et al.

It is certified that error appears in the above-identified patent and that said Letters Patent is hereby corrected as shown below:

Col. 1, line 24, After "An" insert --example of a device which forms a tape handle on a box--

Col. 2, line 61, After "present" delete --,--

Col. 3, line 64, After "assist" delete --:--

Signed and Sealed this

Twenty-sixth Day of October, 1993

*Attest:*

Bruce Lehman

BRUCE LEHMAN

*Attesting Officer*

*Commissioner of Patents and Trademarks*